US005899313A

United States Patent [19]

Pratt

[11] Patent Number: 5,899,313

[45] **Date of Patent: * May 4, 1999**

[54] DEVICE AND METHOD FOR CURRENCY VALIDATION

[76] Inventor: George W. Pratt, 67 Glezen La., Wayland, Mass. 01778

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,819

[22] Filed: Nov. 14, 1996

[51] Int. Cl.[6] ..... G07D 7/00

[52] U.S. Cl. ..... 194/206; 324/673

[58] Field of Search ..... 194/205, 206, 194/207, 212, 213, 303, 317; 324/672, 673, 674, 675; 209/534

[56] References Cited

U.S. PATENT DOCUMENTS

| | | | |
|---|---|---|---|
| 4,536,709 | 8/1985 | Ishida | 194/213 X |
| 5,122,754 | 6/1992 | Gotaas | 194/206 X |
| 5,394,969 | 3/1995 | Harbaugh | 194/206 |
| 5,417,316 | 5/1995 | Harbaugh | 194/206 |
| 5,419,424 | 5/1995 | Harbaugh | 194/206 |
| 5,535,871 | 7/1996 | Harbaugh | 194/206 |

FOREIGN PATENT DOCUMENTS

| | | | |
|---|---|---|---|
| 4-54693 | 2/1992 | Japan | 194/206 |

*Primary Examiner*—F. J. Bartuska
*Attorney, Agent, or Firm*—Samuels, Gauthier & Stevens

[57] ABSTRACT

A system for the verification of the genuineness of currency. The complex electric permittivity of the currency is read by measuring its complex impedance. A particular capacitor arrangement is used to sense the complex electric permittivity of the paper currency.

16 Claims, 4 Drawing Sheets

DEVICE AND METHOD FOR CURRENCY VALIDATION

FIELD OF THE INVENTION

The present invention relates to a method and apparatus for validating paper currency, particularly United States bills, and more particularly to such a method and apparatus in which the authenticity of paper currency is identified by sensing the complex electric permittivity characteristics of the currency.

BACKGROUND AND BRIEF SUMMARY OF THE INVENTION

Genuine U.S. paper currency contains a variety of printed indicia which may be used to identify the currency as authentic, and also to distinguish between authentic currency of various denominations.

One indication of authenticity is the fact that certain areas on a U.S. bill are printed with ink with magnetic properties. For example, the portrait which appears in the center of every U.S. bill is, in a genuine bill, printed entirely with magnetic ink. The fanciful engraving which forms the printed border of each U.S. bill is likewise composed entirely of magnetic ink, as are the large capital letters or large numerals which appear to the right of the portrait and which identify the denomination of the bill (i.e., "ONE", "TWO", "FIVE", etc.). In contrast, the green Treasury Department seal which underlies the denomination identifying letters or numerals to the right of the portrait, as well as the black Federal Reserve Bank seal which appears to the left of the portrait, are both printed in non-magnetic ink.

Each denomination U.S. bill is likewise characterized by the distance between the grid lines which comprise the background of the portrait field. In one dollar bills, for example, the space between vertical grid lines is equal to 0.008 inches. For two and five dollar bills, the grid line space is equal to 0.010 and 0.011 inches, respectively.

Prior art currency validators have been proposed which identify authentic U.S. bills and distinguish between bills of various denominations by measuring the average spacing between the vertical grid lines in the portrait areas of the bills. One such device is disclosed in U.S. Pat. No. 4,349,111, Shah et al.

Identification of bills based on average grid line spacing is likely to lead to failures to distinguish between bills having relatively small differences, in grid spacing. For example, certain commercial bill validators utilizing the average spacing technique cannot be used with both two dollar and five dollar bills, because the average grid line spacings are too similar.

Another problem with various prior art validators is that they may accept high denomination bills as valid lower denomination bills.

Many prior art current validators require that the tested bill be inserted into the validator in. a specific orientation (e.g., Federal Reserve seal first). Such devices result in authentic bills being rejected merely because of improper orientation.

Many of the prior art currency validators require careful regulation of the speed at which the bill is scanned for information. In such validators, even a slight variation in scanning speed, such as that resulting from an instantaneous drop in power line voltage, can cause authentic bills to be rejected and produce inaccuracies in the identification of bill denomination. It is therefore desirable to provide a currency validator which is insensitive to the speed at which a bill is scanned.

In order to avoid some of the problems of speed regulation, some prior art validators, such as disclosed in U.S. Pat. No. 4,464,787, Fish et al., employ detectors at fixed positions by positively identifying the position of the bill and thereby ascertain the bill area being tested. These validators, however, generally require a testing channel at least as long as the bill being tested.

In recent years, the high quality of copying and printing machines has resulted in a serious counterfeiting problem. One of the countermeasures against counterfeiting which has been adopted in many countries is the use of a metal embedded in paper checks or currency notes. However, metal detectors for automatically discriminating between genuine and counterfeit currency notes and checks by detecting the metal strip have not been put to practical use because they have not been capable of accurate and reliable detection of the metal strips at high speed.

An image (on a bill) can be scanned with a resolution of 300 or 600 dots per inch and the stored imager printed using inkjet printers that can match virtually any color.

The present invention overcomes the aforementioned prior art problems and provides a device for accurate detection of counterfeit currency at very high speeds.

Experience has shown that there is a large difference in frequency dependent, electrical complex permittivity between genuine and counterfeit bills. Genuine bills have a substantially different complex permittivity which is distinct from the permittivity of counterfeit bills. The invention broadly measures the complex permittivity, $\epsilon$, of the 'paper' bills to determine if the bill(s) is genuine or counterfeit.

The invention comprises a device and method for determining the genuineness of a bill(s) by measuring the complex permittivity based on the frequency dependent dielectric properties of the bill(s).

The complex electric permittivity of a dielectric material is typically read by measuring complex impedance using a capacitor to sense material properties. There are a wide variety of techniques known in the art for measuring capacitance including RF bridge circuits, oscillators, etc. Preferably the permittivity is sensed as it affects the complex impedance. This may be expressed as it affects the resonant frequency of an oscillator such as a Wein bridge or phase shift oscillator. Electrodes are placed in electrical communication with the bill to be tested. The electrodes may be on opposite sides of the bill or using an interdigitated pattern the sensing electrodes may be on the same side. If interdigitated electrodes are used to sense the permittivity of the bill, the spacing between the electrodes is set so that the fringing electric field permeates the bill, typically 0.004" thick, but does not significantly penetrate the material beneath the bill, i.e. the support surface.

When the sensing electrodes engage the bill, a capacitor is formed. This is due either to the field penetrating the bill between electrodes on opposite sides or due to the fringing field. The value of the capacitance is strongly affected by the electric permittivity of the bill. The capacitor forms part of an oscillator such as a Wien bridge oscillator or a phase shift oscillator, although any oscillator circuit will function as long as its resonance frequency depends upon the value of a capacitor and that capacitor can be formed by the electrode-currency combination. Moisture will affect the surface conductivity of the bill. This can be accounted for by modelling the bill as a capacitor in parallel with a surface resistance. Moisture effects will be less pronounced when using electrodes on each side of the bill.

In a particularly preferred embodiment of the invention, the output frequency from the oscillator is fed to a tone decoder, such as a phase locked loop circuit. The phase locked loop has a frequency capture range. The voltage output of the tone decoder is one of two levels. Level one is realized if the oscillator frequency is within the capture range. Level two is observed if the frequency is outside the capture range. The tone decoder can be configured so that the oscillator frequencies observed for genuine bills lie within the capture range producing a positive output while those for counterfeit bills are outside the capture range and produce a negative output.

It is also within the scope of the invention that the complex electric permittivity of the currency be sensed at a plurality of frequencies. At each of these frequencies, the real and imaginary impedance is measured. These measurements (readings) are compared against a standard, corresponding to genuine currency, which may include using discriminant analysis techniques. An output indicates whether the bill is counterfeit or genuine. Several models can be used to sense the electric permittivity of the currency, i.e. a total impedance model, a voltage divider model or a bridge model. The bridge model can comprise two similar arms A and B, each of which is a parallel combination of a resistor and a capacitor. The parallel combinations of these arms are separately in series with a resistor forming arms C and D. The bridge voltage is read between the nodes at the junction of arm A and arm C and the junctions of arms B and D.

DESCRIPTION OF THE PREFERRED EMBODIMENT(s)

There is a significant difference in the frequency dependent real part of the electrical permittivity between genuine and counterfeit bills regardless of the denomination. The genuine currency always has a substantially higher $\epsilon$ at frequencies up to 1 MHz.

Figure 1:
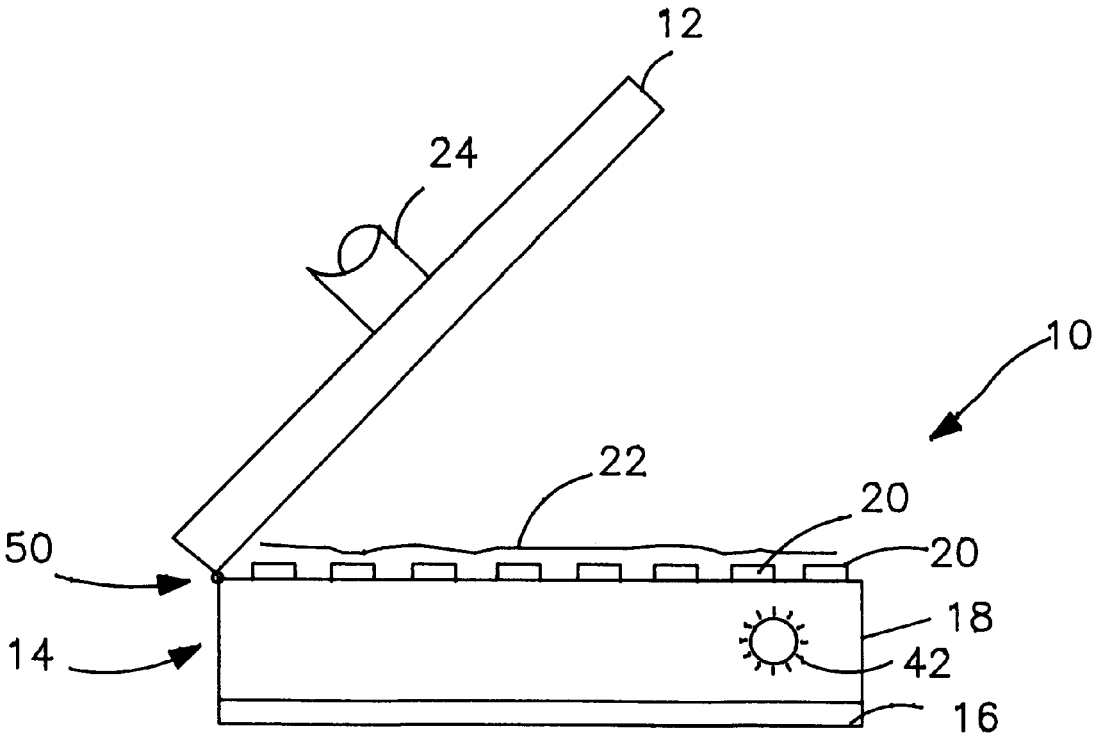
FIG. 1 is an illustration of a device embodying the invention.

Referring to FIG. 1 a device embodying the invention is shown generally at 10 and comprises a TEFLON® (tetrafluoroethylene) cover 12 hinged at 50 to a base shown generally at 14. The base comprises a ground plane 16, a KAPTON® (polyimide) substrate 18 and interdigitated electrodes 20 (shown more clearly in FIGS. 2 and 3). The electrodes 20 are coated with a parylene coating. For a more detailed discussion of interdigitated electrode design and theory see Mamishev, et al., Techniques for Semi-Imperical Characterization of Material and Sensor Properties in Interdigital Dielectromity. Currency 22 is sandwiched between the electrodes 20 and the cover plate 12. A pressure controlling device 24 applies a standardized pressure to the currency 22. A lamp 42 signals whether or not the bill is genuine.

Figure 2:
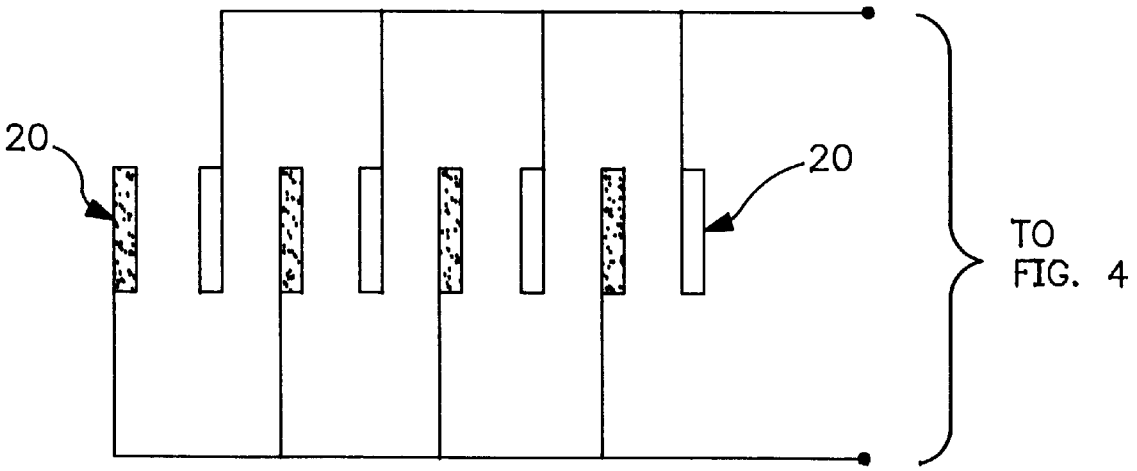
FIG. 2 is a top schematic view of an interdigitated electrode array of the invention.
Figure 3:
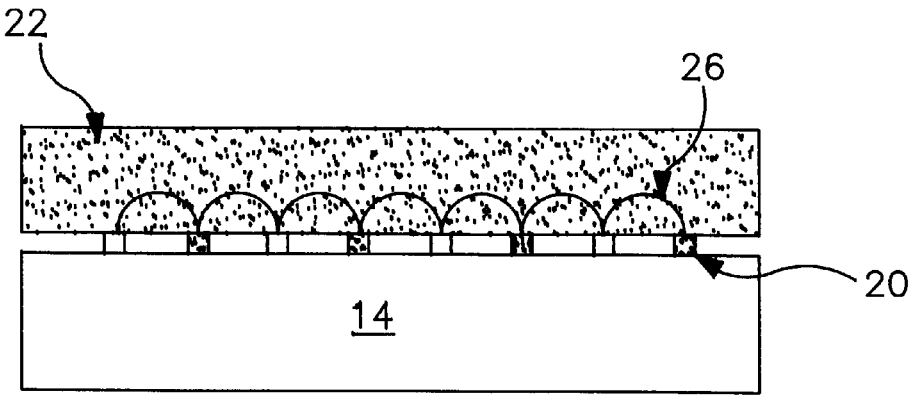
FIG. 3 is a schematic of the electrodes of FIG. 2.

Referring to FIGS. 2 and 3 the electrodes 20 are shown in greater detail with FIG. 3 illustrating the fringing electric field line as 26. The currency 22 is shown in exaggerated form In the preferred embodiment, an electrode with a period of one millimeter is preferred. The electrodes (metal fingers) are about 0.5 mm wide and 0.1 mm thick and the gap between the electrodes is about 0.5 mm. The electrodes are received on a KAPTON flexible substrate. With a sensing frequency in the vicinity of 10 kHz the frequency can be determined in a time frame of milliseconds. The device measures the current between the fingers of the interdigitated electrodes which is CdV/dt where C is the sensed capacitance and dV/dt is the time rate of change of the interdigitated applied voltage.

Figure 4:
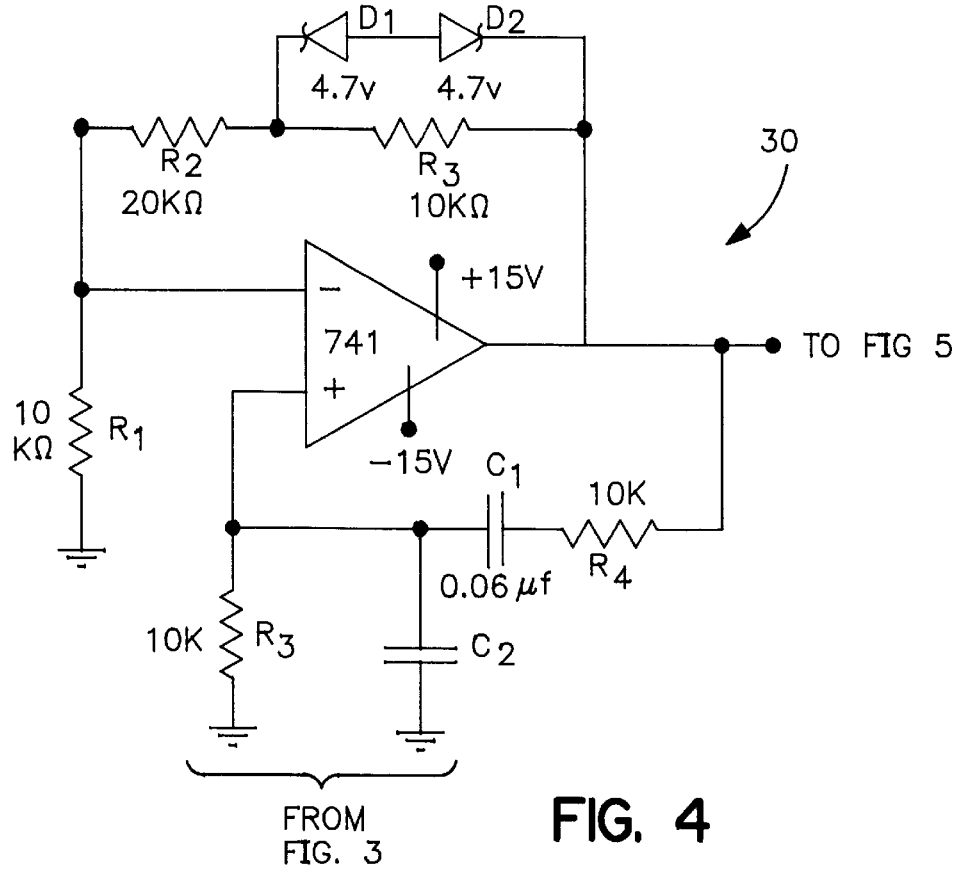
FIG. 4 is a schematic of an oscillator t.

Referring to FIG. 4, an oscillator such as a Wein bridge oscillator is shown at 30. An operational amplifier 741 is configured with two 0–15 volt power supplies.

$C_2$ is the capacitance sensed by the electrode.

$$\text{angular frequency } \omega = \sqrt{\frac{1}{R_3 R_4 C_1 C_2}}$$

$$f = 10\,\text{kHz} = \frac{\omega}{2\pi}$$

$$\omega = 6.28 \times 10^4 \text{rad/sec}$$

$$\text{when } C_2 = 4.2 \times 10^{-5}\,\mu f$$

Figure 5:
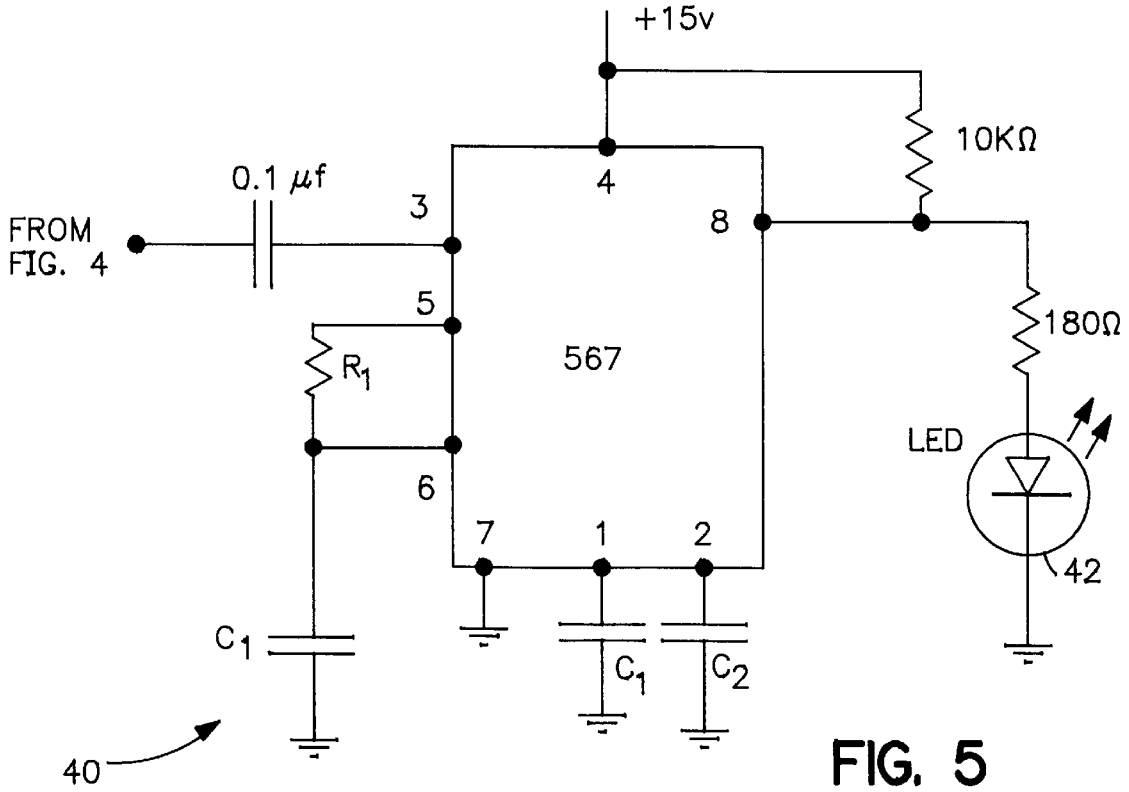
FIG. 5 is a schematic of a tone decoder.

Referring to FIG. 5, a tone decoder 40 is shown which is a phase locked loop which contains a voltage controlled oscillator. The frequency output of the oscillator is $$f = \frac{1}{2\pi}\frac{1}{\sqrt{R_3 R_4 C_1 C_{money}}}$$

Since counterfeit bills have always been found to have a lower real part of the electrical permittivity, i.e. $\epsilon_1$, the $C_{money}$ for counterfeit bills will be lower than $C_{money}$ for genuine U.S. bills. Therefore, the oscillator 30 will oscillate at a higher frequency for counterfeit bills than for genuine bills.

The circuit components are chosen so the genuine bills will cause the oscillator to oscillate between two frequencies, e.g. 10,750 Hz and 9,250 Hz. In general, counterfeit bills will provide a Wein bridge oscillation greater than 10,750 Hz. The phase locked loop 40 goes from unlocked to locked at different frequencies depending upon whether the frequency fed to the phase locked loop is increasing or decreasing.

Figure 6B:
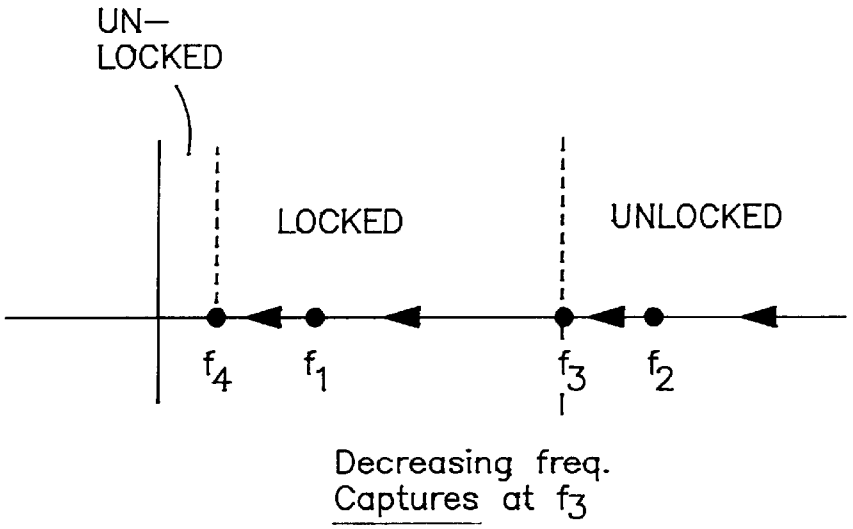
FIGS. 6*a* and 6*b* are frequency diagrams.
Figure 6A:
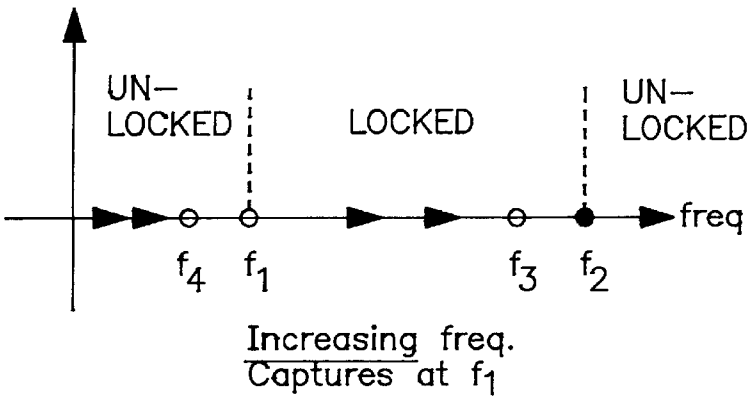

With reference to FIGS. 6*a* and 6*b*, when there is no bill under the sensor the frequency of the Wein bridge will be higher than with a bill under the sensor because $C_{money}$ will be lower since the sensor is looking at air not paper. When the sensor is pressed against the paper bills as the contact becomes more intimate due to applied pressure $C_{money}$ will increase and frequency oscillation will decrease. If the sensor is pressed against the counterfeit bill the frequency oscillation will not decrease enough to reach $f_3$ and the lamp 42 will remain illuminated. If the sensor is pressed against genuine bills the frequency oscillation will read or go below $f_3$. Capture then will be achieved and the lamp 42 will be actuated. The free running frequency, $f_o$, of the decoder is approximately $$f_o \simeq \frac{1.1}{R_1 C_1}\ \text{Hz}$$

$$\text{Let } f_o = 10\,\text{kHz}$$

Assuming a 15% drop in permittivity from genuine to counterfeit bills, $f_3$ should be above $f_O$ by an amount that reflects this change in permittivity. Then using the relationship between Δf and $\Delta C_{money}$ $$\left|\frac{\Delta f}{f}\right| = \left|1/2\Delta\frac{C_{money}}{C_{money}}\right| \frac{\Delta C_{money}}{C_{money}} = 0.15\Bigg|$$

If f is chosen as 10 kHz, Δf=750 Hz. Therefore, let $f_3$ the captive frequency be 10,750 Hz.

As the sensor is pressed against the bill to be tested the bridge oscillator frequency will decrease and the led is on. That frequency must decrease below 10,750 Hz so as to put out the led for the bill to be called genuine.

The spacing between fingers is set so that the fringing electric field penetrates the bill, typically 0.004 inches thick, but does not significantly penetrate the material beneath the bill. That material could be selected to have optimum dielectric properties although such a selection may not be necessary.

In tests conducted on U.S. bills of various denominations, the results at 10 kHz alone distinguished between genuine bills and counterfeit bills supplied by the Secret Service.

A specific array of interdigitated electrodes has been described. It is well within the skill of the art to use other arrays of electrodes either on one side or both sides of the paper currency. Further, other forms of oscillators are well within the scope of the invention as well as other detection schemes to determine whether a bill is genuine or counterfeit.

The preferred embodiment has been described with reference to measuring the permittivity at a frequency of 10 kHz. Other frequencies obviously can be used to achieve the same result. Further, if desired the permittivity of the bills can be tested at more than one frequency. For example, the bills could be tested at 10 kHz, 100 kHz and 1 MHz to further validate the scheme.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method of determining the genuineness of currency, said method comprising the steps of:

sensing complex electric permittivity of paper currency based on frequency dependent dielectric properties of said currency, using a plurality of interdigitated electrodes arranged substantially in a plane and electrically excited by a sensing circuit, wherein the paper currency is positioned against the interdigitated electrodes;

providing an output corresponding to the sensed permittivity; and processing the output to provide an indication regarding whether or not the currency is genuine.

2. The method of claim 1 wherein sensing the electric permittivity of the currency comprises measuring impedance.

3. The method of claim 2 which comprises:

contacting the currency with electrodes to form a capacitor.

4. The method of claim 1 wherein the processing of the output comprises:

outputting a frequency corresponding to a measured capacitance; and sensing if the frequency is within a predetermined range which corresponds to genuine currency.

5. A device for determining the genuineness of paper currency which comprises:

means for measuring permittivity of the currency based on frequency dependent dielectric properties of the currency, comprising a plurality of interdigitated electrodes arranged substantially in a plane and electrically excited by a sensing circuit, wherein the paper currency is positioned against said interdigitated electrodes and said electrodes measure the permittivity across a substantial portion of the currency;

means for providing an output corresponding to the measured permittivity; and means for processing the output to provide an indication regarding whether or not the currency is genuine.

6. The device of claim 5 wherein said means for measuring the permittivity of the currency comprises:

means for measuring capacitance.

7. The device of claim 6 wherein said means for measuring capacitance comprises an RF bridge circuit.

8. The device of claim 6 wherein said means for measuring capacitance comprises an oscillator.

9. The device of claim 5 wherein said means for measuring comprises:

a plurality of electrode sensors adapted to engage the currency and to form with the currency a capacitor.

10. The device of claim 9 wherein said means for measuring comprises:

an oscillator circuit whose resonant frequency depends upon the value of the capacitor formed by the electrode-currency combination.

11. The device of claim 5 wherein said means for processing the output comprises a tone decoder.

12. The device of claim 11 wherein the tone decoder is a phase locked loop circuit.

13. The device of claim 5, wherein said means for measuring comprises a cover which together with said interdigitated electrodes sandwiches the currency.

14. The device of claim 13, wherein said means to measure comprises a pressure controlling device which applies a force to said cover to sandwich the currency between said cover and said electrodes.

15. The device of claim 5, wherein said electrodes are coated with parylene.

16. A device for determining the genuineness of paper currency, comprising:

means for measuring permittivity of the currency based on frequency dependent dielectric properties of the currency, comprising a plurality of parylene coated electrodes arranged on opposite sides of the currency and electrically excited by a sensing circuit; and means for providing an output corresponding to the measured permittivity and for processing the output to provide an indication regarding whether or not the currency is genuine.

* * * * *